US012392220B2

(12) United States Patent
Busengdal et al.

(10) Patent No.: US 12,392,220 B2
(45) Date of Patent: Aug. 19, 2025

(54) VALVE AND METHOD FOR MULTI-STAGE WELL STIMULATION

(71) Applicant: GRANT PRIDECO, INC., Houston, TX (US)

(72) Inventors: Paul David Busengdal, Ikornnes (NO); Tom Rune Koløy, Sandnes (NO); Vijay Kumar Keerthivasan, Sandnes (NO)

(73) Assignee: GRANT PRIDECO, INC., Houston, TX (US)

( * ) Notice: Subject to any disclaimer, the term of this patent is extended or adjusted under 35 U.S.C. 154(b) by 0 days.

(21) Appl. No.: 18/012,148

(22) PCT Filed: Jun. 26, 2020

(86) PCT No.: PCT/NO2020/050186
§ 371 (c)(1),
(2) Date: Dec. 21, 2022

(87) PCT Pub. No.: WO2021/262005
PCT Pub. Date: Dec. 30, 2021

(65) Prior Publication Data

US 2023/0349263 A1 Nov. 2, 2023

(51) Int. Cl.
*E21B 34/14* (2006.01)
*E21B 43/14* (2006.01)
*E21B 43/25* (2006.01)

(52) U.S. Cl.
CPC ..... *E21B 34/14* (2013.01); *E21B 43/14* (2013.01); *E21B 43/25* (2013.01); *E21B 2200/06* (2020.05)

(58) Field of Classification Search
CPC ..... E21B 34/14; E21B 2200/06; E21B 43/14; E21B 43/25
See application file for complete search history.

(56) References Cited

U.S. PATENT DOCUMENTS 4,246,968 A * 1/1981 Jessup ..... E21B 33/146 166/317
4,450,912 A * 5/1984 Callihan ..... E21B 33/146 166/290

(Continued)

FOREIGN PATENT DOCUMENTS

CA 2986346 A1 1/2018
WO 2013/150304 A2 10/2013

(Continued)

OTHER PUBLICATIONS

PCT/NO2020/050186 International Search Report and Written Opinion dated Jan. 18, 2021 (13 p.).

(Continued)

*Primary Examiner* — D. Andrews
(74) *Attorney, Agent, or Firm* — CONLEY ROSE, P.C.

(57) ABSTRACT

A valve for use in a wellbore for facilitating a multi-stage stimulation method includes a first sleeve configured to move to open the valve. In addition, the valve includes a second sleeve configured to move to close the valve. The first sleeve and the second sleeve are both movable in a first direction. Movement of the first sleeve a first distance in the first direction opens the valve and subsequent movement of the second sleeve a second distance in the first direction closes the valve. Further, the valve includes a third profile configured to engage a third key of a tool for operating the valve. The third profile is shaped to prevent movement of the tool in a second direction opposite to the first direction when engaged with the third key of the tool.

14 Claims, 6 Drawing Sheets

(56) References Cited

U.S. PATENT DOCUMENTS

| | | | | |
|---|---|---|---|---|
| 6,257,339 | B1 * | 7/2001 | Haugen | E21B 23/06 166/123 |
| 2011/0048742 | A1 | 3/2011 | Smith et al. | |
| 2013/0175040 | A1 | 7/2013 | Madero et al. | |
| 2017/0067314 | A1 | 3/2017 | Flores et al. | |
| 2018/0266212 | A1 | 9/2018 | Koch et al. | |
| 2018/0347330 | A1 | 12/2018 | Facca et al. | |
| 2019/0032447 | A1 | 1/2019 | Wakefield et al. | |
| 2022/0018213 | A1 * | 1/2022 | Acosta | E21B 33/14 |

FOREIGN PATENT DOCUMENTS

| | | | | |
|---|---|---|---|---|
| WO | 2017/040624 | A1 | 3/2017 | |
| WO | 2017/041105 | A1 | 3/2017 | |
| WO | 2018/170331 | A1 | 9/2018 | |
| WO | WO-2019027509 | A1 * | 2/2019 | E21B 23/01 |

OTHER PUBLICATIONS

Demand Under Article 34/Response to PCT/NO2020/050186 International Search Report and Written Opinion dated Jan. 18, 2021; Response filed Dec. 17, 2021 (82 p.).
PCT/NO2020/050186 Written Opinion dated May 2, 2022 (6 p.).
Response to PCT/NO2020/050186 Written Opinion dated May 2, 2022; Response filed May 9, 2022 (68 p.).
European Partial Supplementary Search Report dated Jan. 19, 2024, for European Application No. 20941639.5 (14 p.).

* cited by examiner

VALVE AND METHOD FOR MULTI-STAGE WELL STIMULATION

CROSS-REFERENCE TO RELATED APPLICATIONS

The present application is a 35 U.S.C. § 371 U.S. National Phase entry of, and claims priority to PCT/NO2020/050186 filed Jun. 26, 2020, and entitled "Valve and Method for Multi-Stage Wells Stimulation," which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates in particular to a valve for use for well stimulation and a method of well stimulation to increase a proportion of extraction of petroleum resources from a reservoir.

Well stimulation is of crucial importance in the petroleum extraction industry to increase production and profitability of petroleum wells. In some cases, particularly for wellbores in formations with low permeability, it may even be necessary to make a well economically viable. Well stimulation may also be necessary in some wells to restore production in wells that have had near-wellbore damage occur to reduce the productivity of the wells.

There have been developed different techniques for well stimulation. One type of well stimulation is stimulation through hydraulic fracturing—breaking down a formation through hydraulic action.

In hydraulic fracturing, a fluid mixed with small round particles called proppants are pumped into the well to be fractured. The fluid is pumped into the well such that the pressure in the well rises. When the pressure increases above a certain threshold known as the formation breakdown pressure, the pressure will cause the formation to fracture. If the pressure is maintained at a sufficient level, the fracture will propagate and grow further into the formation. As a result, the effective area of communication between the wellbore and the formation can be increased, and the productivity from the well can be increased.

Hydraulic fracturing well stimulation techniques have improved significantly over the years. For more efficient well stimulation, methods have been developed where the wellbore is divided into zones to be stimulated, and wherein the zones are stimulated one at a time. Such methods are often referred to as "multistage fracturing".

A commonly used multistage fracturing method is known as the "plug and perf completion method". The method involves stimulating a number of zones, one after the other, through the steps of sealing off a zone by setting a plug, perforating a tubing separating the zone from a formation by use of perforating guns to establish a communication to a formation, and fracturing the formation in the zone by hydraulic pressure. For each of these steps, for each zone, equipment must be run into and/or pulled out of the wellbore.

Newer methods have been developed, taking advantage of new technology. One new method, called "ball-drop activated sleeve completion", involves a lower completion string comprising a number of ball-activated sleeves. By activating a sleeve, communication with a formation is established. This means that, for example, the steps of perforation from the PPC is not necessary when applying the BDC. Not having to perforate may be highly advantageous both for HSE and for time and cost of a well-stimulation operation.

Although the ball-drop activated sleeve completion method may be advantageous compared to the plug and perf completion method in some respects, the ball-drop activated sleeve completion method has some disadvantages. One disadvantage is that the ball-activated sleeves of the lower completion string has ball seats, which may make it more difficult and expensive to enter a well, for example, to remove obstructions. Furthermore, recovery of the balls dropped to activate the sleeves may be problematic, particularly in wells with a high number of ball-activated valves. Balls can get stuck in the wellbore and cause obstructions.

Another method employs valves arranged in a tubing string of a wellbore, wherein the valves each have a sleeve that is movable to open or close the valve. A tool, run on a coiled tubing, is used to engage with a sleeve to move it. To open a valve, the tool is activated, through flow activation, to engage with the sleeve of the valve, a bridge plug of the tool is set to allow for a build-up of fluid pressure in the wellbore, and the wellbore fluid is increased to push the tool and the sleeve downwards. When a valve has been opened, well stimulation may commence. A disadvantage of the method is that the flow activation demands a proppant-free fluid, as opposed to a proppant-laden fluid.

To move the sleeve back to a closed position, the valve is again engaged with by use of the tool, and the tool is pulled upwards to move the sleeve upwards to close the valve. A disadvantage of this method is that it may be challenging, particularly in long/deep wellbores, to apply sufficient downwards force to open the valves of the tubing string. Another disadvantage is that the method may depend on the bridge plug being set correctly in a pressure-tight manner to allow for the opening of a valve.

Other types of well stimulation may include injection of a fluid into a reservoir with a fluid pressure below a formation breakdown pressure, wherein the fluid, for example, is a chemical to treat the reservoir to improve production from the reservoir, or wherein the fluid is injected into a reservoir via an injection line to maintain reservoir pressure to maintain or increase productivity from the reservoir.

WO 2017/041105 A1 discloses a ball-drop activated sleeve assembly, which is used for stimulating multiple stages in a completion string. The sleeve assembly has a lower shifting sleeve and an upper shifting sleeve and stimulation ports formed therebetween.

WO 2018/170331 A1 discloses an assembly of ported valve housings where the housings have an assembly of shifting sleeves. The first sleeve is shifted upwards to open the port in the housing and the second sleeve is shifted in the same direction to close the ports.

Note that "upwards" in the wellbore refers to a direction in the wellbore towards a surface of the wellbore, whereas "downwards" refers to an opposite direction, towards a bottom end of the wellbore.

SUMMARY

Embodiments described herein are defined by the independent claims. The dependent claims define advantageous embodiments.

In a first aspect, an embodiment disclosed herein relates to a valve for use in a wellbore for facilitating for a multi-stage stimulation method, wherein the valve comprises:

a first sleeve being movable for opening the valve; and a second sleeve being movable for closing the valve, wherein the first and the second sleeve are both movable in a first direction, wherein movement of the first sleeve a first distance in the first direction opens the valve and subsequent movement of the second sleeve a second distance in the first direction closes the valve. The valve further comprises a third profile for engaging with a third key of a tool for operating the valve, wherein the third profile is shaped for preventing movement of the tool in a second direction opposite to the first direction when engaged with the third key of the tool.

The first direction may typically be upwards in the wellbore. In some embodiments, the first direction may be downwards in the wellbore. The first distance and the second distance may be a similar distance, or a dissimilar distance.

The valve may be a valve for other purposes than for performing a multi-stage stimulation. The valve may be used for, for example, chemical well treatment of a reservoir, fracturing of a reservoir or for fluid injection into the reservoir.

After having been opened by moving the first sleeve in the first direction and then closed by moving the second sleeve in the same first direction, the valve may again be opened by moving the second sleeve in an opposite, second direction.

The second sleeve may be movable for opening the valve after having been moved to close the valve. The second sleeve may be movable in a first direction to open the valve, and in a second, opposite direction to close the valve.

The first sleeve may be movable from a first first sleeve position to a second first sleeve position. The second sleeve may be movable from a first second sleeve position to a second second sleeve position. The second sleeve may be movable from the second second sleeve position to the first second sleeve position or a third second sleeve position. The second second sleeve position may be a closed position. The first second sleeve position may be an opened position. The third second sleeve position may be an opened position. The first first sleeve position may be a closed position. The second first sleeve position may be an open position. The first sleeve may be movable to a third position. The third position may be an opened first sleeve position, or it may be a closed first sleeve position.

The first sleeve may comprise a first profile for receiving a first key for engaging with and operating the first sleeve for moving the first sleeve. The second sleeve may comprise a second profile for receiving a second key for engaging with and operating the second sleeve for moving the second sleeve. The first profile may be different from the second profile. The shape of the first profile and the shape of the second profile may be dissimilar. The first profile may require a different key for being moved than the second profile. Different profiles, requiring different keys, may be advantageous as it may allow for a first key to pass the second profile without engaging with the second profile and/or moving the second sleeve and/or allow for a second key to pass the first profile without engaging with the first profile and/or moving the first sleeve.

The second sleeve may comprise the third profile. The third profile is configured to engage with a third key of a tool and for locking the tool to prevent downwards movement of the tool.

The valve may further comprise a protection sleeve which may be configured to ensure that the first and/or the second sleeve avoid getting stuck due to cementing of a tubing that comprises the valve. The protection sleeve is arranged to cover a void space in the valve to prevent, for example, cement or well debris getting from filling and blocking a part of the void space. The void may be sized and configured to allow movement of a sleeve of the valve, such as the first sleeve and/or the second sleeve.

The valve may further comprise a first release mechanism for releasing the first key from the first profile. The valve may further comprise a second release mechanism for releasing the second key from the second profile. The first release mechanism may be configured to apply a force onto the first key to release the first key from engagement with the first profile. The second release mechanism may be configured to apply a force onto the second key to release the second key from engagement with the second profile. In a preferred embodiment, the first release mechanism may comprise a first releaser: a part of the valve that is shaped such that when a part of the first key comes into contact with it and forced against it, the first key is pushed out of engagement with the first profile. Similarly, in a preferred embodiment, the second release mechanism may comprise a second releaser: a part of the valve that is shaped such that when a part of the first key comes into contact with it and forced against it, the second key is pushed out of engagement with the second profile.

The valve may further comprise one or more circumferential seals. The first and/or the second sleeve may each comprise one or more circumferential seals, e.g. for providing one or more seals between the first and/or second sleeve and a tubular wall, e.g. an inner or an outer wall of a tubular along which wall the first and/or second sleeve is movable.

One or both of the sleeves may comprise a triple-seal arrangement of circumferential seals. Such a triple-seal arrangement may be advantageous for allowing the sleeves to move even under high differential pressure while ensuring all three seals are intact, which in turn allows a continual open-close functionality of the sleeves, which means that the sleeves may be opened and closed continually. The triple-seal arrangement may comprise, for example, a combination of one or more hard plastic seals/gaskets, one or more rubber seals/gaskets, one or more metal seals/gaskets, or combinations thereof. In an advantageous embodiment, the triple-seal arrangement may comprise a first hard plastic seal and a second and a third rubber seal.

The valve may further comprise a retention means or a retention device that may be configured to keep a sleeve from unintentional moving. The retention device may be configured to keep a sleeve locked in position until a force is applied to the sleeve that is sufficient to move it despite the retention device. In an embodiment, the retention device may comprise a "snap ring" or "c-ring", a metal c-shaped ring that is radially flexible. The retention device may be positioned in an outer groove in one of the sleeves. The valve may have more than one retention device, for example, one retention device for each of the first and second sleeve, one retention device for each of the first, the second and the protection sleeve, or more than one retention device for at least one of the sleeves. The retention device may alternatively comprise, for example, one or more collets and/or spring-loaded keys.

The valve may be operable to selectively open or close a flow path for a fluid to flow from an interior and an exterior of a wellbore, or from an exterior to an interior of the wellbore. The interior may be the interior of a tubing, such as a production tubing or a casing. The exterior may comprise a reservoir, for example, a hydrocarbon reservoir.

In a second aspect, an embodiment disclosed herein relates to a tubing comprising one or more valves according to the first aspect.

The tubing may be a production casing. The tubing may be a tubing string, such as a production casing string. The tubing may be any other type of tubing or casing.

The tubing may comprise a plurality of valves according to the first aspect.

In a third aspect, an embodiment disclosed herein relates to a wellbore comprising one or more valves according to the first aspect. The wellbore may comprise the tubing according to the second aspect.

In a fourth aspect, an embodiment disclosed herein relates to a tool for operating the valve according to the first aspect, wherein the tool comprises a first key for engaging with a first part of the valve for opening the valve and a second key for engaging with a second part of the valve for closing the valve, wherein the tool is configured to operate the valve by being pulled in a first direction, wherein operating the valve includes both opening and closing the valve. The tool comprises further the third key for engaging with the third profile of the valve for locking the tool in a position for preventing movement of the tool in the second direction opposite to the first direction.

The first direction may be an upwards direction in a wellbore or a downwards direction in a wellbore. In an advantageous embodiment, the first direction is an upwards direction in the wellbore.

In a fifth aspect, an embodiment disclosed herein relates to a system for stimulating a well, wherein the system comprises the valve according to the first aspect and the tool according to the fourth aspect. The system may comprise the tubing according to the second aspect and/or the wellbore according to the third aspect. The system may comprise a plurality of valves.

In a sixth aspect, an embodiment disclosed herein relates to a method of operating the valve according to the first aspect to open and close the valve, wherein the method comprises the steps of:

using a tool to operate the valve;

moving the tool a first distance in a first direction to open the valve; and moving the tool a second distance further in the first direction to close the valve.

The method may further comprise the step of:

engaging a first profile of the valve with the tool and moving the tool while in engagement with the first profile to open the valve.

Furthermore, the method may comprise the step of:

engaging a second profile of the valve with the tool and moving the tool while in engagement with the second profile to close the valve.

The first profile may be a part of or connected to a first sleeve. The second profile may be a part of or connected to a second sleeve.

The method may comprise the step of:

moving a first sleeve to open the valve.

The method may comprise the step of:

moving a second sleeve to close the valve.

The valve may be a valve in a wellbore. A tubing in a wellbore may comprise the valve.

The valve may separate an inner bore inside a casing/tubing of the wellbore from a formation outside the casing/tubing.

The method may comprise the step of providing the tool to operate the valve. The step of providing the tool may be a step of providing the tool in a wellbore to operate the valve in the wellbore.

The method may further comprise the step of moving the tool a third distance in a second, opposite direction to open the valve. The third distance may be similar to the first and/or the second distance, or dissimilar to one or both of the first and second distance. The step of moving the tool in the second, opposite direction may be a step of moving the second sleeve so as to open the valve. If so, the tool may be in engagement with the second sleeve while moving the tool in the second direction. The step of moving the tool in the second, opposite direction may be a step of moving the tool downwards in a wellbore. The step of moving the tool in the second, opposite direction may be a step to open the valve subsequently of performing the step of moving the tool further in the first direction to close the valve.

The tool may be activatable by use of an activation mechanism, from a first deactivated state to an activated state. In the first deactivated state the tool may be lowerable into a wellbore without going into engagement with the first and/or the second part of the valve. The tool may further comprise a deactivation mechanism, to deactivate the tool and change its state from the activated state to a second deactivated state. The first deactivated state and the second deactivated state may be different states, with different configurations of the tool. In some embodiments, it is possible that the second deactivated state is the same state with the same configuration of the tool as the first deactivated state.

The activation mechanism may comprise a destructible device. The activation mechanism may be configured to activate the tool upon destruction of the destructible device. The destructible device may be, for example, a shearable device or a dissolvable device or a burstable device.

The destructible device may be destructible in response applying a mechanical force upon it. The tool may be configured such that a mechanical force may be applied to the destructible device when the tool is pushed against a landing in the wellbore. The landing may be a bottom of the wellbore or a piece of equipment in the wellbore. The piece of equipment may be a piece of equipment particularly installed in the wellbore for receiving the tool for destruction of the destructible device. The piece of equipment may be referred to as a "no-go sub" and be configured to not allow the tool to pass it.

The dissolvable device may be dissolvable, for example, when exposed to a particular fluid or a category of fluid. The dissolvable device may comprise a material that may react such that it will dissolve upon exposure to the particular fluid or category of fluid. The particular fluid or category of fluid may, for example, be of a pH above or below a certain threshold, or have another particular characteristic or sum of characteristics that allows for a reaction with the material of the dissolvable device. The dissolvable device may be configured to dissolve quickly over a short period of time upon exposure to the particular fluid or category of fluid or slowly over a longer period of time. The dissolvable device may comprise a material which may dissolve or lose mechanical rigidity when exposed to high temperature. The short period of time may be less than one hour, less than 30 minutes, less than 15 minutes, or less than five minutes. The longer period of time may be more than 30 minutes, more than one hour, more than three hours or more than six hours.

The burstable device may be burstable, for example, when exposed to a certain pressure such as a fluid pressure.

By destruction of the destructible device, the tool may be configured such that a movement will follow that may put the tool into an activated state wherein at least one of the first or second keys is moved into an active position. The tool may comprise a biasing member for biasing a part of the tool to move following destruction of the destructible device to put the tool into the activated state.

Alternatively, the tool may comprise an apparatus for activating the tool, for example, upon receiving a signal that is transmitted to the tool. The apparatus may comprise a mechanical device that initiates activation of the tool. The mechanical device may, for example, be used to destroy the destructible device to initiate a movement to active the tool, it may move a movable device to active the tool, or it may otherwise provide or cause a movement to activate the tool.

The first and/or the second key may be collapsed when the tool is in the first deactivated state. The first and/or the second key may be collapsed when the tool is in its second deactivated state.

"Collapsed" or "collapsing" may refer to a state or moving to a state wherein the key does not stand out sufficiently from a core or mandrel or housing or similar of the tool to engage with a profile of the valve.

In a preferred embodiment, the third key may be collapsed when the tool is in its first deactivated state. The third key may be collapsed when the tool is in its second deactivated state. The tool may be configured for a fluid to flow through the tool. The tool may be configured for a fracturing fluid to flow through the tool. In an alternative embodiment the tool may be configured for a fracturing fluid to be conveyable on an outside of the tool to a zone to be fractured.

The tool may be referred to as a "shifting tool". The tool may comprise an upper part that may be referred to as an "upper shifting tool" and a lower part that may be referred to as a "lower shifting tool". The upper shifting tool may comprise one or more of the keys. The lower shifting tool may comprise one or more of the keys. In a preferred embodiment, the upper shifting tool comprises an upper key and the lower shifting tool comprises a middle key and a lower key. The upper key may be the first key, the middle key may be the second key and the lower key may be the third key.

The valve may be configured such that movement of a sleeve may be blocked in a direction when the sleeve is in a position. For example, the first sleeve may be configured to not be movable further upwards when it has reached and is in its open position and/or not be movable downwards when it is in a locked position, and/or the second sleeve may be configured to not be movable further upwards when it has reached and is in its closed position or to not be movable downwards when it is in its closed position.

The method according to the fourth aspect may comprise the step of providing the tool according to the fifth aspect.

The method may comprise the step of running the tool down in a wellbore past a valve to be operated by the tool. The method may comprise the step of running the tool on a coiled tubing. Alternatively, the tool may be run, for example, on a wireline. The step may be a step of running the tool on, for example, a drillpipe, a workstring, or an E-line.

The method may further comprise activating the tool. The method may comprise destroying a destructible device to activate the tool. The method may comprise pushing the tool downwards towards a landing in the wellbore to activate the tool. The method may comprise using a fluid to dissolve a dissolvable device or using a fluid pressure to burst a burst device.

The method may further comprise the step of pulling the tool upwards in the wellbore to a valve to engage with the valve to operate the valve. The step of pulling the tool upwards in the wellbore to a valve to engage with the valve may be performed subsequently of the step of activating the tool. The step of activating the tool may be performed subsequently of running the tool down a wellbore past a valve to be operated by the tool.

In a seventh aspect, an embodiment disclosed herein relates to a method of stimulating a well, the method comprising the steps of:

a. providing the wellbore according to the third aspect;
b. opening one of the one or more valves to open a flow path to a formation; and
c. stimulating a formation on an exterior of the valve opened in step b.

The pressurised fluid may comprise a proppant.

The step of stimulating the formation may include, for example, fracturing the formation by providing a pressurised fluid into the formation, providing a chemical into the formation, providing an acid into the formation, and/or providing an injection fluid into the formation for increasing the pressure in the formation.

The method according to the seventh aspect may further comprise any one or more of the steps according to the method of operating a valve according to the sixth aspect.

The method according to the sixth aspect and/or the method according to the seventh aspect may comprise the step of engaging the third profile of the valve with a third key of the tool to lock the tool in position to prevent downwards movement of the tool. Either or both of the methods may comprise the step of applying a downwards force to the tool.

The method of stimulating the well may comprise the step of closing the valve. The valve may be a first valve.

The method may further comprise the step of repeating one or more of the previously mentioned steps of the invention for further valves. The steps may be repeated in order for one valve at a time as follows: a valve is opened, the formation on an exterior of the valve is stimulated, the valve is closed.

The step of opening the valve may comprise engaging a first profile of the valve, and thereby a first sleeve of the valve, with a first key of the tool and subsequently moving, for example, by pulling, the tool upwards in the well to open the valve.

The step of fracturing the formation may comprise the following steps:

engaging the third profile of the valve with a third key of the tool to lock the tool from moving downwards in the well; and applying a downwards force onto the tool to keep the tool in position in engagement with the third profile of the valve.

The two steps may typically be performed prior to providing the pressurised fluid in the wellbore.

The wellbore may comprise a plurality of valves according to the first aspect. The step of opening a valve, the step of fracturing a formation behind the opened valve, and/or the step of closing the valve may be repeated for any number of the plurality of valves according to the first aspect in the wellbore. The number may be e.g. two, five, ten, twenty or higher than twenty.

The method of stimulating the well may be advantageous over the prior art for several reasons, including:

There may be no need for setting a plug or a packer, which may save time and reduce a risk of a workstring getting stuck;

The method may not be reliant on a tight plug or packer, which may eliminate a risk of failure due to problems with the plug or packer; and Downwards movement of the tool may not be required to open or close a valve, which may eliminate the challenge of being able to provide a sufficient downwards force to move the tool in that direction.

The reservoir behind a well-stimulating valve may be a zone of a larger reservoir or referred to as a zone of a wellbore or a well.

The steps b to d of the method according to the seventh aspect may be repeated for a plurality of well-stimulation valves, such as 5, 10, 15, 20, 25 or more than 25 well-stimulation valves. The method according to the seventh aspect may comprise the method according to the sixth aspect.

The method according to the seventh aspect may comprise providing the tool according to the fourth aspect to operate the well-stimulation valve. The method according to the seventh aspect may comprise providing the system according to the fifth aspect.

Isolating a zone/reservoir to be stimulated may be of great importance for the quality of the stimulation to be sufficient, for example, for facilitating for a correct pressure and/or flow rate of a fluid to be injected to stimulate the well. In prior art, isolation is typically achieved by setting one or more packers or plugs. Embodiments described herein, including the method according to the seventh aspect, provide a solution that excludes the need of setting a plug or packer for isolating a zone/reservoir.

The system according to the fifth aspect may be a system for performing the method according to the seventh aspect.

The tool according to the fourth aspect may comprise a deactivation device for deactivating the tool. By deactivating the tool by use of the deactivation device, the tool may be set to the second deactivated state. Deactivation of the tool may include deactivation of one or more of the keys of the tools. In a preferred embodiment, deactivation may include deactivation of the first key. The keys and/or the valves may be configured such that if the first key is deactivated, the tool will not engage with a sleeve of a valve to open the valve, and/or that if the valve has not been opened the second key will not change a state of the valve. Deactivation of the tool may include collapsing the first key, the second key and/or the third key.

The deactivation device may include a movable seat, in a tube of the tool, for receiving a ball. The seat and the ball may be configured such that when the ball is placed in the seat, the tube will be closed off such that a fluid pressure may be built up in the tube. The fluid pressure may be utilised to push the movable seat. The movable seat may in turn directly or indirectly force a movement of one or more keys so as to collapse the one or more keys.

In another embodiment, or additionally, the deactivation device may comprise a shearable or destructible device that may be sheared or destructed to deactivate the tool. The tool may be configured to allow for deactivation by pulling the tool with a force over a certain threshold or in a certain manner when the first key is in engagement with the first profile. The deactivation may include damaging a key, for example, the second or third key, but more typically the first key, so as to disable the key from engaging with its corresponding profile sufficiently to operate the valve. In another embodiment, the deactivation may include pushing a key, for example, the second or third key, but more typically the first key, into or towards a housing, a mandrel or a core or similar of the tool, so as to disable the key from engaging with a profile.

The tool may have a spacious design to reduce a risk that, for example, proppant or debris from the well can get stuck and disable movement of one or more movable parts.

The method according to the sixth aspect and/or the method according to the seventh aspect may comprise the step of deactivating the tool. The step of deactivating the tool may comprise the step of inserting a tool into the well and running the ball to the tool and landing the ball in the seat, and applying a fluid pressure to the ball to move the seat to deactivate the tool. Alternatively, or additionally, the step of deactivating the tool may comprise the step of engaging a profile of the valve with a key of the tool and applying a force to the tool to deactivate the tool. The deactivation may be achieved by at least partly pushing the key into the tool to deactivate the key. The force may be applied by pulling the tool upwards or by pushing the tool downwards.

Embodiments of the tool may be retrievable from a wellbore after deactivation. Deactivation of an embodiment of the tool may be necessary in some situations, for example, if the tool has become stuck in a wellbore. In other situations, the tool may be retrieved from the wellbore without a need for deactivation, for example, in a situation where all valves that are engageable by the tool has been engaged and opened and subsequently closed.

The step of moving the tool in the second, opposite direction to open the valve may be performed to one or more valves subsequently of performing a well stimulation operation that includes stimulation of a plurality of reservoirs and the opening and subsequent closing of a plurality of valves. The step of moving the tool in the second, opposite direction to open the valve may be a step to re-opening a valve. The step of re-opening the valve may be performed to start production from a reservoir or to prepare for start of production from the reservoir.

The tool according to the fourth aspect may comprise an activation mechanism that is operable remotely for remote activation of the tool when the tool is located downhole, to push at least one of the keys outwards releasing the at least one key into an activated state. It may be advantageous to activate the tool downhole, for example, if the tool has a feature that may make it challenging or impossible to lower the tool to its intended position in a wellbore subsequently of activation of the tool.

The tool may be a well-intervention tool. The tool may be referred to as an activatable tool. The tool may be a tool to be run temporarily in a wellbore. The tool may be a tool to be run on wireline, a drillpipe, a coiled tubing and/or a e-line. The tool may comprise a dissolvable material and may be activatable through dissolving the dissolvable material. The dissolvable material may be dissolvable when exposed to a certain fluid or category of fluid, such as e.g. a fluid of a pH over or under a certain threshold, a fluid with a salinity over a certain threshold, a fluid comprising a certain chemical. The tool may be activatable by application of a fluid pressure to the tool, wherein the fluid pressure is a fluid pressure over a certain threshold. The tool may comprise a burstable material that may burst when exposed to a fluid pressure over a certain threshold. The activation mechanism may comprise the burstable material and/or the dissolvable material. Removal or destruction of the dissolvable material and/or the burstable material may activate or be required to subsequently activate the tool.

The activation mechanism may comprise a spring. The spring may be activated as a result of or otherwise following dissolving of a dissolvable material or bursting of a burstable material, for example, by application of a fluid pressure following a dissolving of the dissolvable material or a second pressure pulse following a pressure pulse for bursting the burstable material. The tool may be configured to be activated from forcing the tool with a force above a certain threshold against an item in a wellbore, or a part of the tool against another part of the tool. The item in the wellbore or the another part of the tool may be a no-go profile, or any other item that may, for example, obstruct and prevent downwards movement of the tool. The application of the force against the item or the another part of the tool may, for example, activate the spring and thereby activate the tool. Instead of, or in addition to, the spring, the activation mechanism may comprise another resilient member or another means that may activate, release or move to activate the tool. The activation mechanism may, for example, comprise a shearable device that may be sheared e.g. as a result of applying a downwards force to the tool against an obstruction in the wellbore, such as the no-go profile, or of applying a rotational force to the tool, for example, against an item obstructing rotation.

The tool may comprise a key to engage with, for example, a valve or a piece of equipment in the wellbore. The key may be configured to be pushed outwards against a wall of the wellbore upon activation of the tool. The activatable tool may an embodiment of the tool according to the fifth aspect.

According to an eight aspect, an embodiment disclosed herein relates to a method of activating the tool in accordance with the fourth aspect, wherein the method comprises the steps of:

providing the tool into a wellbore;

lowering the tool to a position in the wellbore for activation of the tool;

activating the tool.

The step of activating the tool may comprise the step of bursting a burstable material and/or dissolving a dissolvable material and/or shearing a shearable device. The step of activating the tool may comprise the step of forcing the tool against an item in or near the position in the wellbore, and/or forcing a part of the tool against another part of the tool, with a force above a certain threshold, so as to activate the tool.

The step of activating the tool may be performed remotely, in that one or more actions is performed remote from the tool for activating the tool. The step may, for example, be to inject into the wellbore a fluid for dissolving the dissolvable material or increasing the pressure of a fluid in the wellbore for bursting a burstable material.

The activation of the tool may comprise a release of a resilient member so as to push a key of the tool outwards against a wall of a wellbore.

The tool according to the fourth aspect of the invention may comprise a deactivation mechanism, and the tool is configured to be remotely deactivatable, wherein deactivation of the tool facilitates removal of the tool from the wellbore, by collapsing at least one of the keys.

The tool may be conveyable downhole by use of, for example, coiled tubing, a drillpipe, a workstring, a wireline or an e-line. The tool may be referred to as a deactivatable tool. The deactivation mechanism may comprise, for example, a deactivation sleeve that is movable, wherein sufficient movement of the sleeve will deactivate the tool. The deactivation sleeve may comprise a seat for receiving an object for blocking a tube forming a flow path in the tool. The flow path may be blocked when the sleeve receives the object. The object may be, for example, a ball, or an object formed as e.g. a cone or formed in any other way fit to block the flow path when the object is landed in the seat. Blocking the flow path enables a build-up of fluid pressure in the tool. The fluid pressure may then force the deactivation sleeve to move such as to deactivate the tool.

Alternatively, or additionally, the deactivation mechanism may comprise a shearable device that may be sheared, for example, when a force is applied to the shearable device. The force may be applied to the shearable device, for example, by pulling the tool against an obstacle in the wellbore. When or subsequently of shearing the shearable device, the tool may be deactivated.

The tool may include a part or a portion of the tool configured to move into or partly into an inner portion of the tool, so as to restrict or reduce an outer reach of the part or the portion of the tool.

The part or the portion of the tool may be a part or portion of the tool configured to engage with, for example, a piece of equipment or a valve in the wellbore, such as a key to engage with a profile of a sleeve of a valve. Deactivation of the tool may include moving the part or portion inwards, away from a wall of the wellbore.

The part or portion of the tool may be moved inwards by pushing it inwards by pulling the tool with a force over a certain threshold against an obstacle in the wellbore. Alternatively or additionally, the part or portion of the tool may be moved inwards by altering a state of a resilient member that in a first state pushes the part or portion into an activated position and in a second state allows the part or portion to collapse inwards. The part or portion may be configured to collapse inwards when the resilient member is in its second state.

Having the tool be deactivatable may be highly advantageous to facilitate pulling of the tool out of the wellbore. The deactivatable tool may be an embodiment of the tool according to the fifth aspect and/or the activatable tool according to the ninth aspect.

In a ninth aspect, an embodiment disclosed herein relates to a method of deactivating the tool in accordance with the fourth aspect, wherein the deactivation of the tool comprises the steps of:

providing the tool in a wellbore;

performing an action to deactivate the tool to change the state of the tool to a deactivated state, so as to facilitate a removal of the well-intervention tool from the wellbore.

One or more actions may be performed for deactivating the tool. One or more actions may be performed remotely from the tool. One action to deactivate the tool may be to inject a ball into the wellbore to land the ball in a seat of a sleeve in the tool to block a flow path in the tool. Another action may be to increase the pressure of a wellbore fluid, for example, to burst a burstable material to deactivate the tool, or to push the ball to move the sleeve to deactivate the tool.

The tool may comprise a part of the tool extending outwardly towards a wall of the wellbore. The step of performing an action to deactivate the well-intervention tool may include an action of pulling the tool upwards so that the part engages with an obstruction for the part in the wellbore. The action may include pulling the tool with a force over a certain threshold to shear or break a shearable or breakable device of the tool, for collapsing the part such that the part following the collapse does not extend as far outwardly, thereby deactivating the tool. The deactivation of the tool may include collapsing a part, such as a key or another part extending outwardly towards a wall of the wellbore, such as to lower or eliminate a risk of the part engaging with an obstacle or a wall of the wellbore, such as to facilitate removal of the tool from the wellbore. The part of the tool may be pushed fully or partly into a section, portion, pocket or similar of the tool as part of the deactivation of the tool.

The deactivation of the deactivatable tool and/or the activation of the activatable tool may include altering a shape of a resilient member, such as a curvature of a resilient member, to alter how far the resilient member pushes a part of the deactivatable and/or activatable tool outwardly towards a wall of the wellbore. The resilient member may be held in a deactivated state and an activated state. The altering of the shape of the resilient member may result in a change of state from the deactivated state to the activated state or vice versa. In the activated state, the resilient member may push the part of the tool, such as a key for engaging with a profile of a valve of a wellbore, further outwardly towards a wall of the wellbore than in the deactivated state.

BRIEF DESCRIPTION OF THE DRAWINGS

In the following is described examples of preferred embodiments illustrated in the accompanying drawings, wherein.

DETAILED DESCRIPTION

Note that the figures are not necessarily drawn to scale, and that they illustrate mere models of embodiments that may not include all details that actual physical embodiments may include.

Figure 1A:
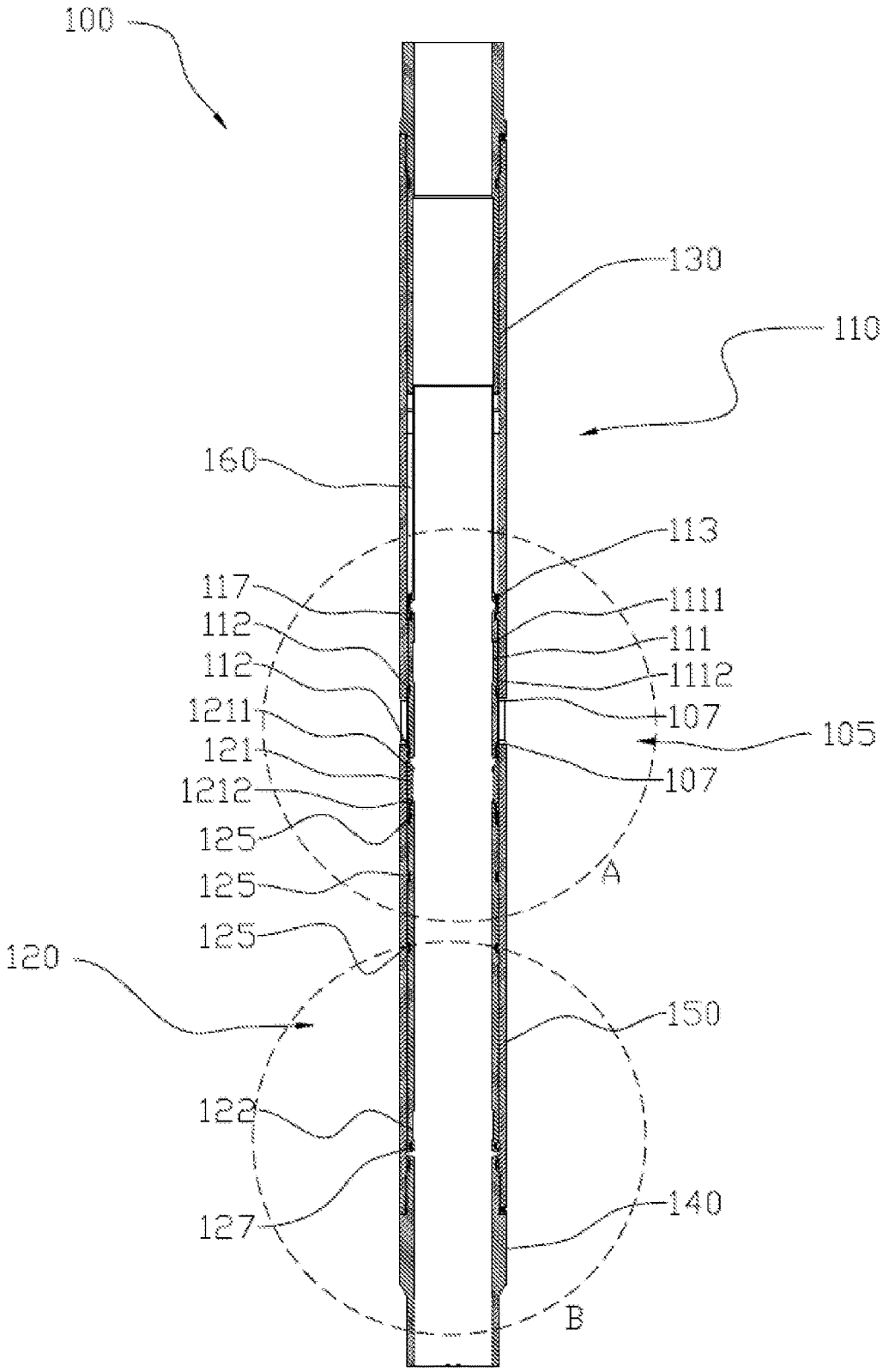
FIGS. 1*a-c* illustrate a cross-sectional view of an embodiment of the valve according to the first aspect.
Figure 1B:
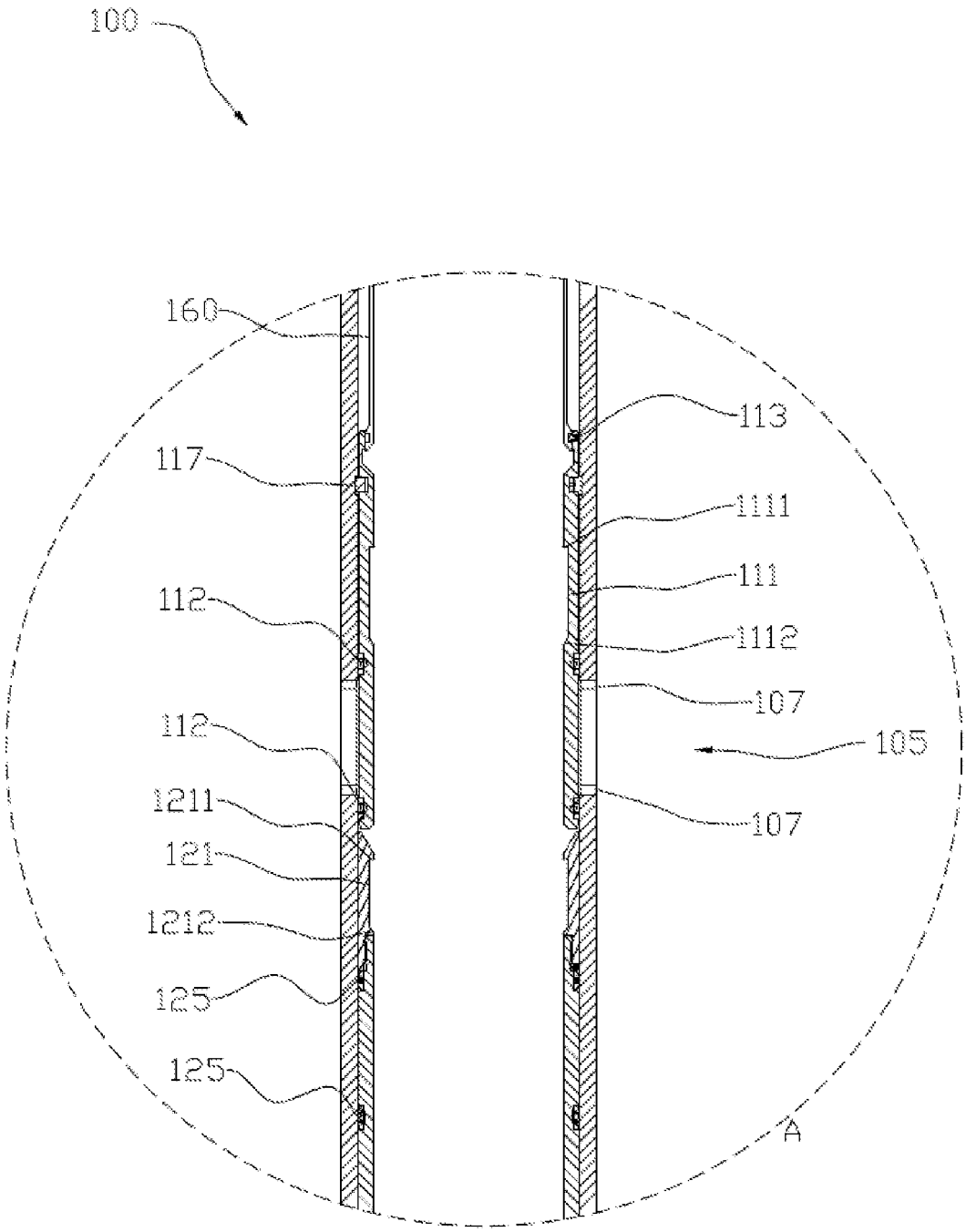
Figure 1C:
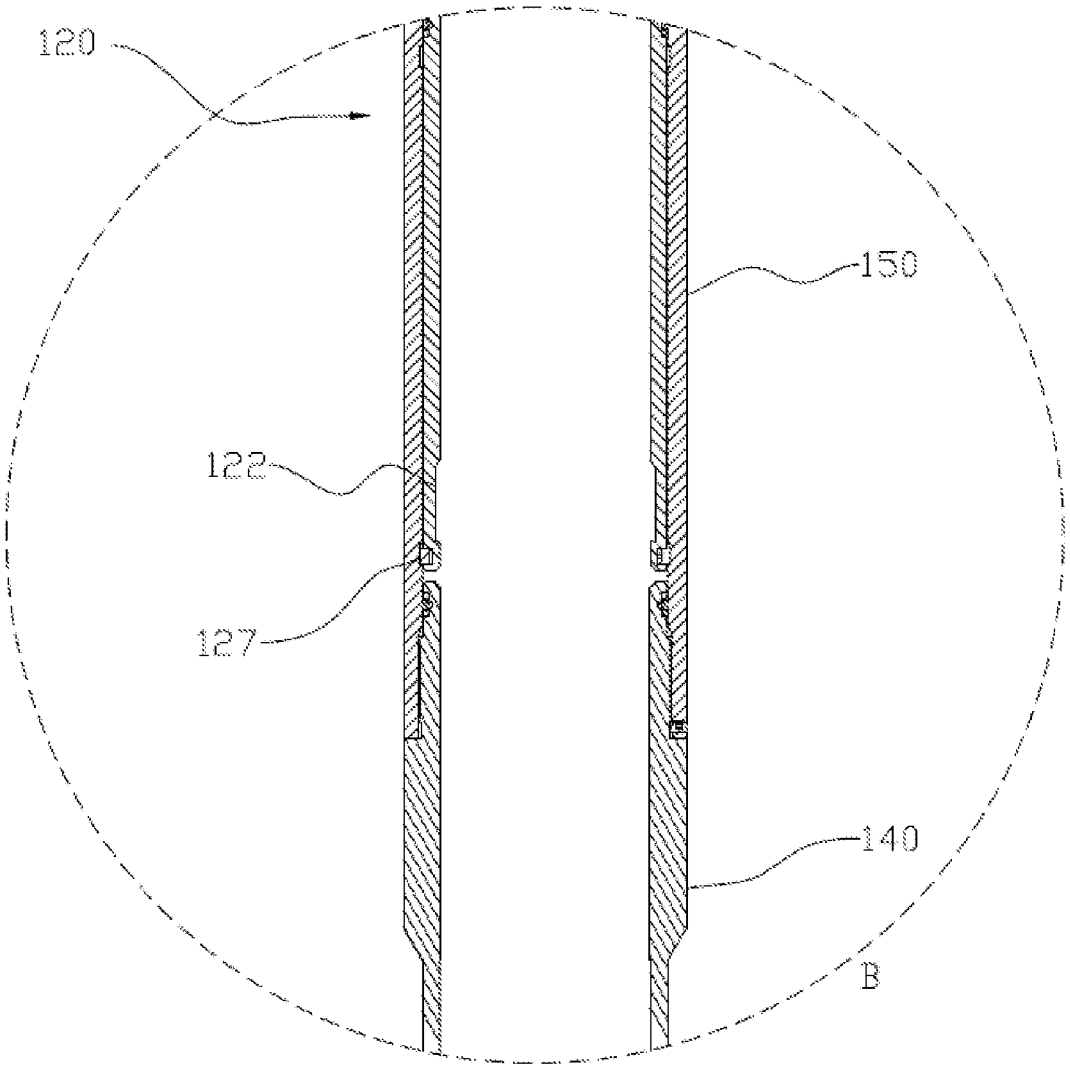

FIG. 1*a* shows an embodiment of the valve 100 according to the first aspect of the invention. FIGS. 1*b* and 1*c* show section A and B from FIG. 1*a* in a larger scale. The valve 100 includes a first sleeve 110, a second sleeve 120, and a protection sleeve 160. Furthermore, the valve 100 includes an upper end portion 130 and a lower end portion 140. The sleeves 110, 120, 160 are movable, but the movement is restricted. The first sleeve 110 and the protection sleeve 160 are connected via a shear screw 113 so as to move together, and has their movement restricted upwardly by the upper end portion 130 and downwardly by the second sleeve 120. The second sleeve 120 is a lower sleeve 120, and has its movement restricted upwardly by first sleeve 110 and downwardly by the lower end portion 140.

The protection sleeve 160 is configured to cover a space of the valve 100 that the first sleeve 110 is configured to move into when moved, to keep the space free from e.g. cement or well debris or other items that may prevent movement of the first sleeve 110.

When the valve 100 is installed, prior to movement of one of the sleeves 110, 120, the valve 100 is closed in a first closed state, with the first sleeve 110 in a closing position and the second sleeve 120 in an opening position. In the first closed state the first sleeve 110 covers an outlet 105 having two flow ports 107 in the valve 100. When the first sleeve 110 is moved upwards, it will be moved to an opening position, which, when the second sleeve 120 is kept in an opening position, will uncover the outlet 105 and open the valve 100. When the first sleeve 110 is in an opening position, the second sleeve 120 can be moved upwards to a closing position, to cover the outlet 105 and thereby closing the valve 100. The first sleeve 110 has a first profile 111 for receiving a key for operating the first sleeve 110. The first profile 111 includes a depression and a first profile upper edge 1111 with a right angle for restricting movement of the key relative to the sleeve 110 while moving the key upwards, and a first profile lower edge 1112 with a blunt angle for allowing such relative movement for allowing a key to pass the first profile 111 while moving the key downwards.

The first sleeve 110 also includes two first sleeve gaskets 112 to provide seals between the first sleeve 110 and a wall 150 of the valve 100.

The second sleeve 120 has a second profile 121 of the valve 100 for receiving a key for operating the second sleeve 120. Like the first profile 111, the second profile 121 has an second profile upper edge 1211 with a right angle for restricting movement of a key relative to the second profile 121 when the key is moved upwards, and a second profile lower edge 1212 with a blunt angle for allowing relative movement of a key relative to the second profile 121 when the key is moved downwards. The second profile upper edge 1211 may in alternative embodiments be a sharp angle, e.g. a 80 degree angle, a 70 degree angle or a 65 degree angle, or be a blunt angle, of e.g. 95 degrees or 100 degrees. The same may be the case for other edges that are herein described as having a right angle.

The second sleeve 120 further has a third profile 122 of the valve 100 for receiving a key for operating the second sleeve 120. Unlike the first profile 111 and the second profile 121, the third profile is configured to restrict downwards movement of a key and to allow upwards movement of the key relative to the second sleeve 120.

The second sleeve 120 has three second sleeve gaskets 125 to provide seals between the second sleeve 120 and the wall 150 of the valve 100.

The first sleeve 110 and the second sleeve 120 has an upper and a lower snap 117, 127 ring respectively. The snap rings 117, 127 are fit in machined grooves in their respective sleeves 110, 120 and function as retention devices to keep the sleeves 110, 120 in place until a shifting force is applied that is great enough to collapse a ring 117, 127 to allow movement of the sleeve 110, 120. The snap rings 117, 127 may be referred to as "C-rings", as they are c-shaped. The snap rings 117, 127 are metal rings that are radially flexible. Other embodiments of the valve 100 may have alternative retention means 117, 127 to prevent unintentional movement of the sleeves 110, 120, such as e.g. collets or spring-loaded key.

Figure 2:
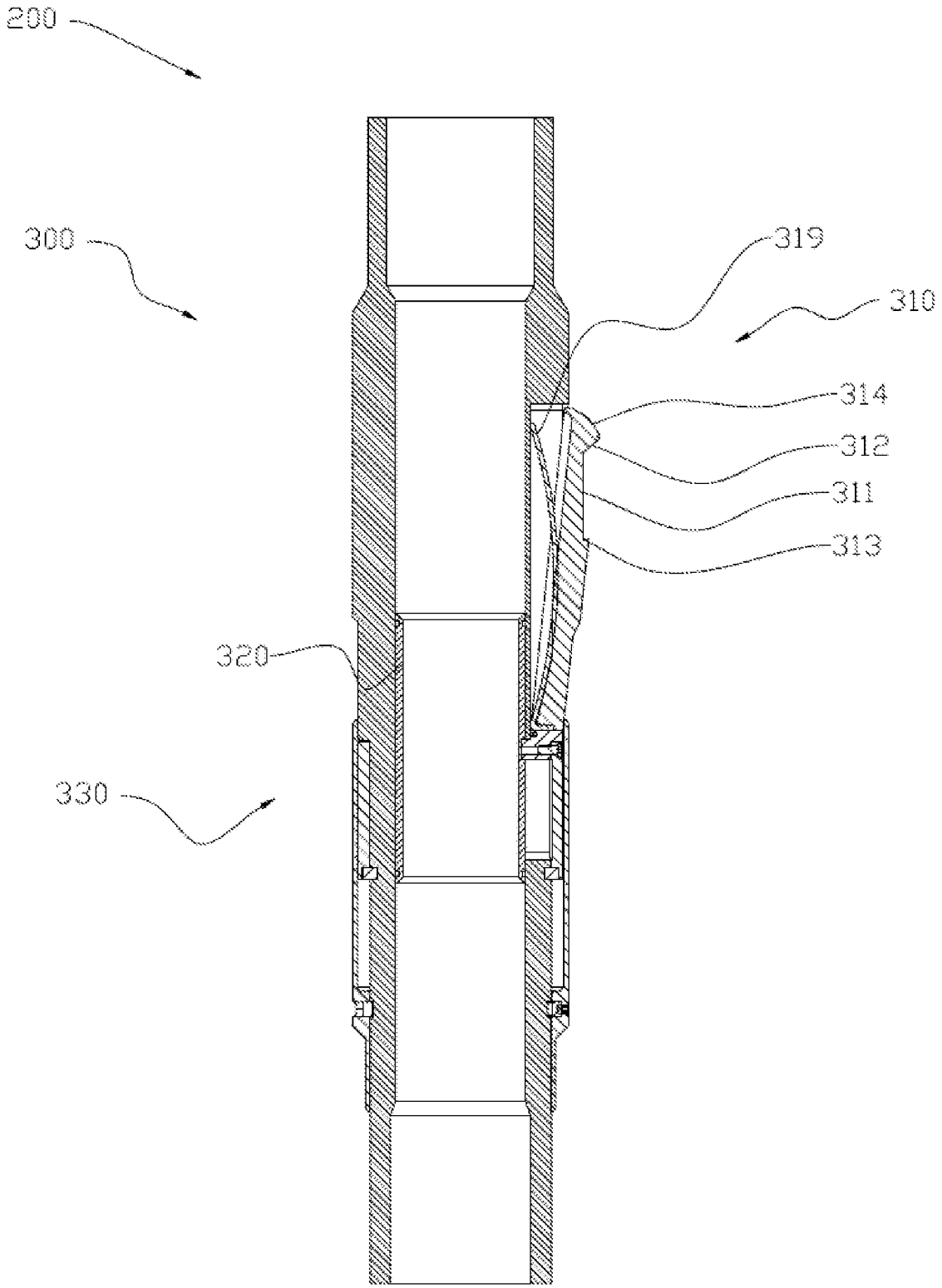
FIG. 2 illustrates a cross-sectional view of an embodiment of an upper shifting tool, a first part of an embodiment of the tool according to the fifth aspect.

FIG. 2 shows a part 300 of a tool 200 for engaging with and operating the valve 100. The part 300 is called an upper shifting tool 300. The upper shifting tool 300 includes a first key 310 for engaging with the first profile 111 of the valve 100. The first key 310 is configured so as to not get caught up by a profile of the valve 100 when the tool is run downwards in a wellbore comprising the valve 100, but to engage firmly with a profile of the valve when the tool is run upwards. To achieve this, the first key 310 includes a depression 311 that has an upper edge 312 and a lower edge 313, wherein the upper edge 312 has a blunt angle and the lower edge 313 has a right angle. Additionally, the first key 310 has a first key upper end 314 which is curved.

The upper shifting tool 300 further has a first key activating member 319 that is biased to push the first key 310 outwards into an active position. In an inner tube of the upper shifting tool 300, the upper shifting tool 300 has a ball-activated sleeve 320. The ball-activated sleeve 320 is configured to receive an object, a "ball", for blocking the tube to allow for a fluid pressure to build up in the tube to push the ball-activated sleeve 320 downwards. The first key activating member 319 has a curved shape, an upper connection to a wall of the upper shifting tool 300 and a lower connection to the ball-activated sleeve 320. When the ball-activated sleeve 320 has been moved to a second, lower position, after having been pushed downwards by use of fluid pressure, the distance between the upper connection and the lower connection of the first key activating member 319 is increased, relative to its default, first position, prior to movement of the ball-activated sleeve 320. With a greater distance between the two connection points, the curvature of the first key activating member 319 is reduced, thus reducing the distance the first key activating member 319 pushes the first key 310. By pushing the ball-activated sleeve 320 downwards, and reducing the distance the first key activated member 319 pushes the first key 310, the first key 310 and/or the upper shifting tool 300 and/or the tool 200 may be said to have been deactivated. The ball-activated sleeve 320 and the first key activating member 319 may be said to be parts of a deactivation mechanism 330.

Figure 3:
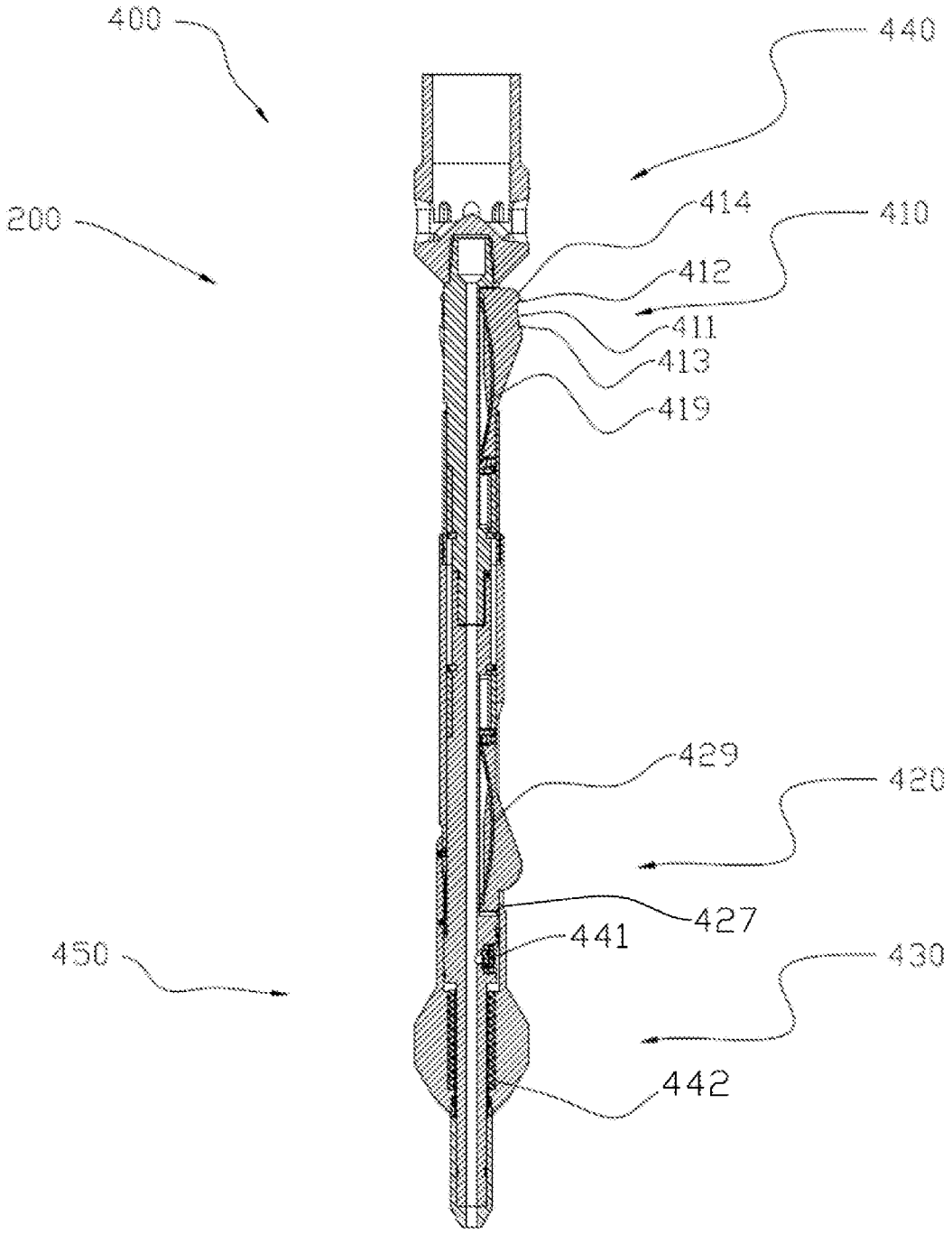
FIG. 3 illustrates a cross-sectional view of an embodiment of a lower shifting tool, a second part of an embodiment of the tool according to the fifth aspect.

FIG. 3 shows a second part 400 of the tool 200, a lower shifting tool 400, for engaging with the valve 100. The lower shifting tool 400 comprises a flow sub 440 for providing a flow path for a fluid to go from within a workstring/coiled tubing to outside for stimulating a well, a second key 410, a third key 420, and a centralizer 430.

Like the first key 310, the second key 410 and the third key 420 each has a curved activating member 419, 429, that is configured to push its corresponding key 410, 420 outwards. The lower shifting tool 400 is configured to be deactivated prior to and during running of the lower shifting tool 400 downwards in a wellbore, primarily to stop the third key 420 from engaging with a profile of a valve 100 or other equipment in the wellbore. The deactivation is achieved by at least partly pocketing the keys 410, 420 in a second key pocket 417 and a third key pocket 427, the pockets 417, 427 being formed by walls of the lower shifting tool 400. The pockets 417, 427 are configured to restrict the reach of the keys 410, 420 and to keep them in a deactivated state.

The lower shifting tool 400 further has an activation mechanism 450 that includes the second and third key activating members 419, 429. The activation mechanism 450 further includes a burst disc 441 that is configured to burst upon being exposed to fluid of a pressure at or above a certain threshold, and a spring 442. The spring 442 is held in place, in a first position, by a destructible, movable or removable restriction device (not shown) for restricting the spring 442 from extending its length. The spring 442 is biased to extend when the restriction device is destroyed, moved or removed, and to push on a wall of the lower shifting tool 400 to move the second key 410 and the third key 420 from their respective pockets, at least partly, thereby allowing the keys 410, 420 to be released into their activated state where they project further outwards.

The second key 410, like the first key 310, has a depression 411 with a lower edge 413 with a right angle and an upper edge 412 with a blunt angle, and a curved upper end 414.

The right-angled lower edges 313, 413 of the first key 310 and the second key 410 are configured to lock against right-angled edges 1111, 1211 of profiles 110, 120 of a valve 100 when moving the tool 200 upwards in a wellbore. These right-angled edges 313, 413 allows the first key 310 and the second key 410 to engage with the sleeves 110, 120 of the valve 100 for operating the valve 100 by moving the sleeves 110, 120 upwards.

The blunt-angled upper edges 312, 412 of the first key 310 and the second key 410 are configured to not lock their respective keys 310, 410 to profiles of a valve 100, to allow the first and the second keys 310, 410 to pass a valve 100 when moving the tool 200 downwards in a wellbore.

The curved upper ends 314, 414 of the first key 310 and the second key 410 are configured such that their respective keys 310, 410 will be pushed inwards when the upper ends 314, 414 are forced against a protruding member of a valve 100 or other equipment in a wellbore, to release the first and/or the second keys 310, 410 from locked engagement with a profile when moving the tool upwards in a wellbore.

Figure 4:
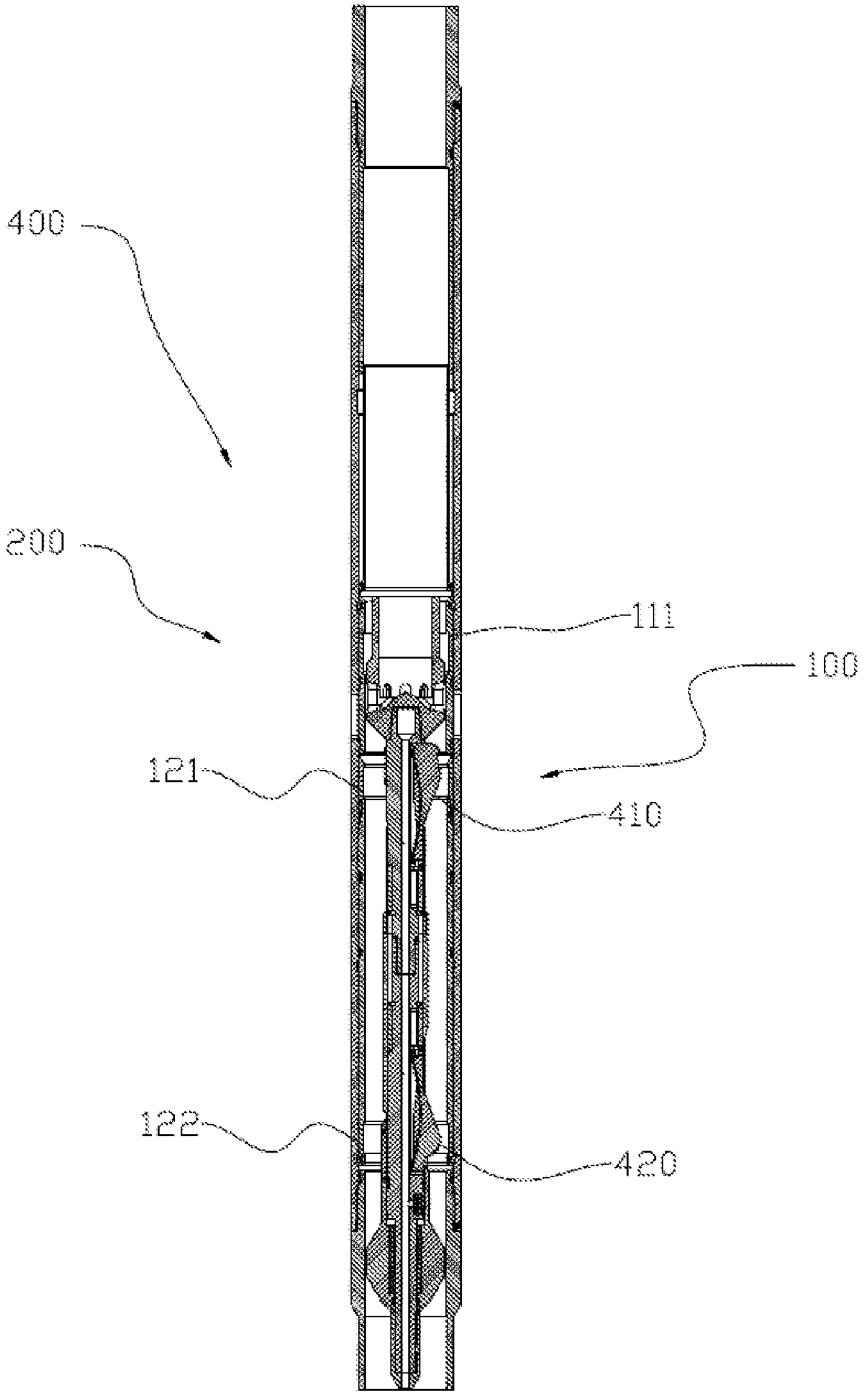
FIG. 4 illustrates a cross-sectional view of the lower shifting tool in a valve according to the first aspect.

FIG. 4 shows the lower shifting tool 400 of the tool 200 placed within a valve 100. The valve 100 is place in a tubing (not shown) in a wellbore (not shown). In the illustration, the lower shifting tool 400 can be seen deactivated, as both the second key 410 and the third key 420 can be seen compacted, not reaching far enough outwards to engage with any of the profiles of the valve 100.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A valve for use in a wellbore for facilitating a multi-stage stimulation method, the valve comprising:

a first sleeve configured to move to open the valve, wherein the first sleeve comprises a first profile configured to engage a first key of a tool for operating the valve;

a second sleeve configured to move to close the valve, wherein the second sleeve comprises a second profile configured to engage a second key of the tool for operating the valve;

wherein the first sleeve and the second sleeve are both movable in a first direction, wherein movement of the first sleeve a first distance in the first direction opens the valve and subsequent movement of the second sleeve a second distance in the first direction closes the valve;

wherein the second sleeve of the valve comprises a third profile configured to engage a third key of the tool for operating the valve, wherein the third profile is shaped to prevent movement of the tool in a second direction opposite to the first direction when engaged with the third key of the tool, wherein the first profile and the second profile are of dissimilar shape and are configured to engage with dissimilar keys;

a first retention device configured to prevent unintentional movement of the first sleeve in the first direction to open the valve;

a second retention device configured to prevent unintentional movement of the second sleeve in the first direction to close the valve; and a protection sleeve connected to and movable with the first sleeve, wherein the protection sleeve is configured to cover a space in the valve that the first sleeve moves into when moved.

2. A tubing comprising the valve of claim 1.

3. A wellbore comprising one or more valves of claim 1 or one or more tubings of claim 2.

4. A tool for operating the valve of claim 1, wherein the tool comprises the first key configured to engage with the first profile of the first sleeve for opening the valve and the second key configured to engage with the second profile of the second sleeve for closing the valve, wherein the tool is configured to operate the valve by being pulled in the first direction, wherein operating the valve includes both opening and closing the valve, wherein the tool further comprises the third key configured to engage with the third profile of the valve for locking the tool in a position for preventing movement of the tool in the second direction opposite to the first direction.

5. The tool in accordance with claim 4, further comprising an activation mechanism that is operable remotely for remote activation of the tool when the tool is located downhole, to push at least one of the keys outwards releasing the at least one key into an activated state.

6. The tool of claim 5, wherein the tool comprises a deactivation mechanism, and wherein the tool is arranged to be remotely deactivatable, wherein deactivation of the tool facilitates removal of the tool from the wellbore, by collapsing at least one of the keys.

7. A method of stimulating a well, the method comprising the steps of:

a. providing the wellbore of claim 3;

b. opening one of the one or more valves to open a flow path to a formation; and c. stimulating the formation on an exterior of the valve opened in step b.

8. The method of claim 7, the method further comprising the step of:

d. closing the valve that was opened.

9. The method of claim 8, wherein the method comprises repeating steps b to d for another one of the one or more valves.

10. A system for stimulating a well, the system comprising:

a valve for use in a wellbore for facilitating a multi-stage stimulation method, the valve comprising:

a first sleeve configured to move to open the valve, wherein the first sleeve comprises a first profile configured to engage a first key of a tool for operating the valve;

a second sleeve configured to move to close the valve, wherein the second sleeve comprises a second profile configured to engage a second key of the tool for operating the valve;

wherein the first sleeve and the second sleeve are both movable in a first direction, wherein movement of the first sleeve a first distance in the first direction opens the valve and subsequent movement of the second sleeve a second distance in the first direction closes the valve;

wherein the second sleeve of the valve comprises a third profile configured to engage a third key of the tool for operating the valve, wherein the third profile is shaped to prevent movement of the tool in a second direction opposite to the first direction when engaged with the third key of the tool, wherein the first profile and the second profile are of dissimilar shape and are configured to engage with dissimilar keys;

a first retention device configured to prevent unintentional movement of the first sleeve in the first direction to open the valve;

a second retention device configured to prevent unintentional movement of the second sleeve in the first direction to close the valve; and a protection sleeve connected to and movable with the first sleeve, wherein the protection sleeve is configured to cover a space in the valve that the first sleeve moves into when moved; and the tool of any one of claim 4, 5, or 6.

11. A method of operating a valve, the method comprising:

using the tool of any of claim 4, 5, or 6 to operate the valve, wherein the valve comprises:

a first sleeve configured to move to open the valve, wherein the first sleeve comprises a first profile configured to engage a first key of a tool for operating the valve;

a second sleeve configured to move to close the valve, wherein the second sleeve comprises a second profile configured to engage a second key of the tool for operating the valve;

wherein the first sleeve and the second sleeve are both movable in a first direction, wherein movement of the first sleeve a first distance in the first direction opens the valve and subsequent movement of the second sleeve a second distance in the first direction closes the valve;

wherein the second sleeve of the valve comprises a third profile configured to engage a third key of the tool for operating the valve, wherein the third profile is shaped to prevent movement of the tool in a second direction opposite to the first direction when engaged with the third key of the tool, wherein the first profile and the second profile are of dissimilar shape and are configured to engage with dissimilar keys;

a first retention device configured to prevent unintentional movement of the first sleeve in the first direction to open the valve;

a second retention device configured to prevent unintentional movement of the second sleeve in the first direction to close the valve; and a protection sleeve connected to and movable with the first sleeve, wherein the protection sleeve is configured to cover a space in the valve that the first sleeve moves into when moved; and moving the tool the first distance in the first direction to open the valve; and moving the tool the second distance further in the first direction to close the valve.

12. The method according to claim 11, wherein the method further comprises:

moving the tool a third distance in the second direction opposite the first direction to re-open the valve.

13. A method of activating the tool of claim 5, wherein the method comprises the steps of:

providing the tool into a wellbore;

lowering the tool to a position in the wellbore for activation of the tool; and activating the tool.

14. A method of deactivating the tool of claim 6, wherein the deactivation of tool comprises the steps of:

providing the tool in a wellbore;

performing an action to deactivate the tool to change the state of the tool to a deactivated state, so as to facilitate a removal of the tool from the wellbore.

* * * * *